US011821641B2

(12) United States Patent
Chung et al.

(10) Patent No.: US 11,821,641 B2
(45) Date of Patent: Nov. 21, 2023

(54) FAULT DIAGNOSIS METHOD IN A DEHUMIDIFIER APPLIANCE

(71) Applicant: Haier US Appliance Solutions, Inc., Wilmington, DE (US)

(72) Inventors: Myunggeon Chung, Seoul (KR); Youngmin Han, Seoul (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 71 days.

(21) Appl. No.: 17/705,662

(22) Filed: Mar. 28, 2022

(65) Prior Publication Data

US 2023/0314022 A1 Oct. 5, 2023

(51) Int. Cl.

| | |
|---|---|
| ***F24F 11/38*** | (2018.01) |
| ***F24F 11/52*** | (2018.01) |
| ***F24F 1/0083*** | (2019.01) |
| *F24F 110/20* | (2018.01) |

(52) U.S. Cl.

CPC ..... *F24F 11/38* (2018.01); *F24F 1/0083* (2019.02); *F24F 11/52* (2018.01); *F24F 2110/20* (2018.01)

(58) Field of Classification Search

CPC ..... F24F 11/38; F24F 11/52; F24F 1/0083; F24F 2110/20

See application file for complete search history.

(56) References Cited

U.S. PATENT DOCUMENTS

| | | | | |
|---|---|---|---|---|
| 6,070,110 | A * | 5/2000 | Shah | G05D 22/02 165/238 |
| 10,030,883 | B2 * | 7/2018 | Liu | F24F 11/526 |
| 2006/0255164 | A1 * | 11/2006 | Oppermann | F24F 3/14 236/44 C |
| 2010/0269526 | A1 * | 10/2010 | Pendergrass | F24F 11/65 62/277 |
| 2016/0258648 | A1 * | 9/2016 | Liu | F24F 11/526 |
| 2022/0154957 | A1 * | 5/2022 | Joo | F24F 11/523 |

FOREIGN PATENT DOCUMENTS

| | | | |
|---|---|---|---|
| CN | 107543286 | B | 11/2020 |
| CN | 111998448 | A | 11/2020 |
| CN | 112781178 | A | 5/2021 |
| CN | 113900887 | A * | 1/2022 |

* cited by examiner

*Primary Examiner* — Nelson J Nieves

(74) *Attorney, Agent, or Firm* — Dority & Manning, P.A.

(57) ABSTRACT

A dehumidifier appliance may include a cabinet, a refrigeration assembly, an air handler, and a condensate collection tray. A controller is configured to initiate a dehumidification cycle, determine that the dehumidification cycle has failed, prompt a user to confirm that all external sources of humidity are blocked, receive user confirmation that all external sources of humidity are blocked, determine that the dehumidification cycle is still failing after receiving the user confirmation, and identify a fault with the dehumidifier appliance.

20 Claims, 10 Drawing Sheets

FAULT DIAGNOSIS METHOD IN A DEHUMIDIFIER APPLIANCE

FIELD OF THE INVENTION

The present subject matter relates generally to dehumidifier appliances, and more particularly, to methods for diagnosing faults in dehumidifier appliances.

BACKGROUND OF THE INVENTION

Dehumidifying appliances or dehumidifiers and other air treatment devices, such as air cleaners, and personal coolers (i.e., swamp coolers), are a common for use in the home and office. Typical dehumidifiers often include a refrigeration system having compressor, along with a collection bucket to gather water condensation that gathers at the refrigeration system. An air flow system, such as a fan and one or more ducts, draws in ambient air that dehumidified and expelled from the dehumidifier. Generally, water extracted from the air is collected in a collection bucket that is periodically emptied or replaced as water condensation fills the collection bucket.

In general, dehumidifying appliances may operate by driving a room humidity to a target humidity. If the target humidity is not reached in a satisfactory amount of time, the appliance may assume that there is a fault with the appliance. However, in certain situations, the failure of a dehumidifying appliance to reach the target humidity may not be due to appliance operation at all. For example, a user may have inadvertently left a door open to the room being dehumidified, thereby permitting a flow of humid air to continuously flow into the room. In such a situation, the dehumidifying appliance may incorrectly diagnose a fault with the appliance.

Accordingly, a dehumidifying appliance having an improved method for detecting faults would be useful. More specifically, a method of diagnosing faults in a dehumidifying appliance that accounts for external flows of air, e.g., through an open door or window, would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, a dehumidifier appliance includes a cabinet defining an airflow path that extends between an air inlet and an air outlet spaced apart from the air inlet, an air handler operably coupled to the airflow path for selectively urging a flow of air therethrough, a refrigeration assembly mounted within the cabinet along the airflow path for selectively dehumidifying the flow of air, and a controller in operative communication with the air handler and the refrigeration assembly. The controller is configured to initiate a dehumidification cycle, determine that the dehumidification cycle has failed, prompt a user to confirm that all external sources of humidity are blocked, receive user confirmation that all external sources of humidity are blocked, determine that the dehumidification cycle is still failing after receiving the user confirmation, and identify a fault with the dehumidifier appliance.

In another exemplary embodiment, a method of diagnosing faults in a dehumidifier appliance is provided. The method includes initiating a dehumidification cycle, determining that the dehumidification cycle has failed, prompting a user to confirm that all external sources of humidity are blocked, receiving user confirmation that all external sources of humidity are blocked, determining that the dehumidification cycle is still failing after receiving the user confirmation, and identifying a fault with the dehumidifier appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
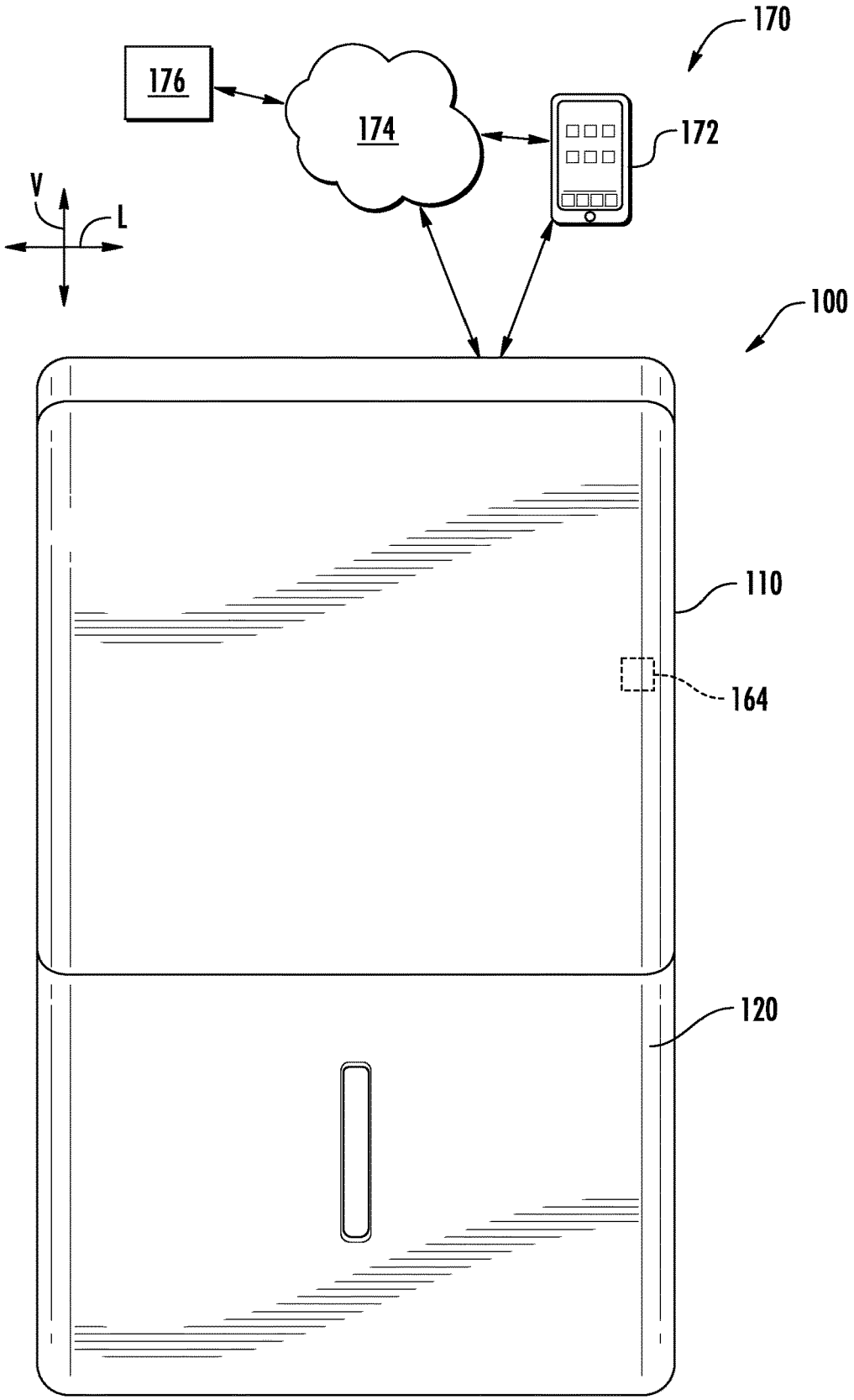
FIG. 1 provides a front elevation view of a dehumidifier appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. Furthermore, as used herein, terms of approximation, such as "approximately," "substantially," or "about," refer to being within a ten percent margin of error.

Figure 2:
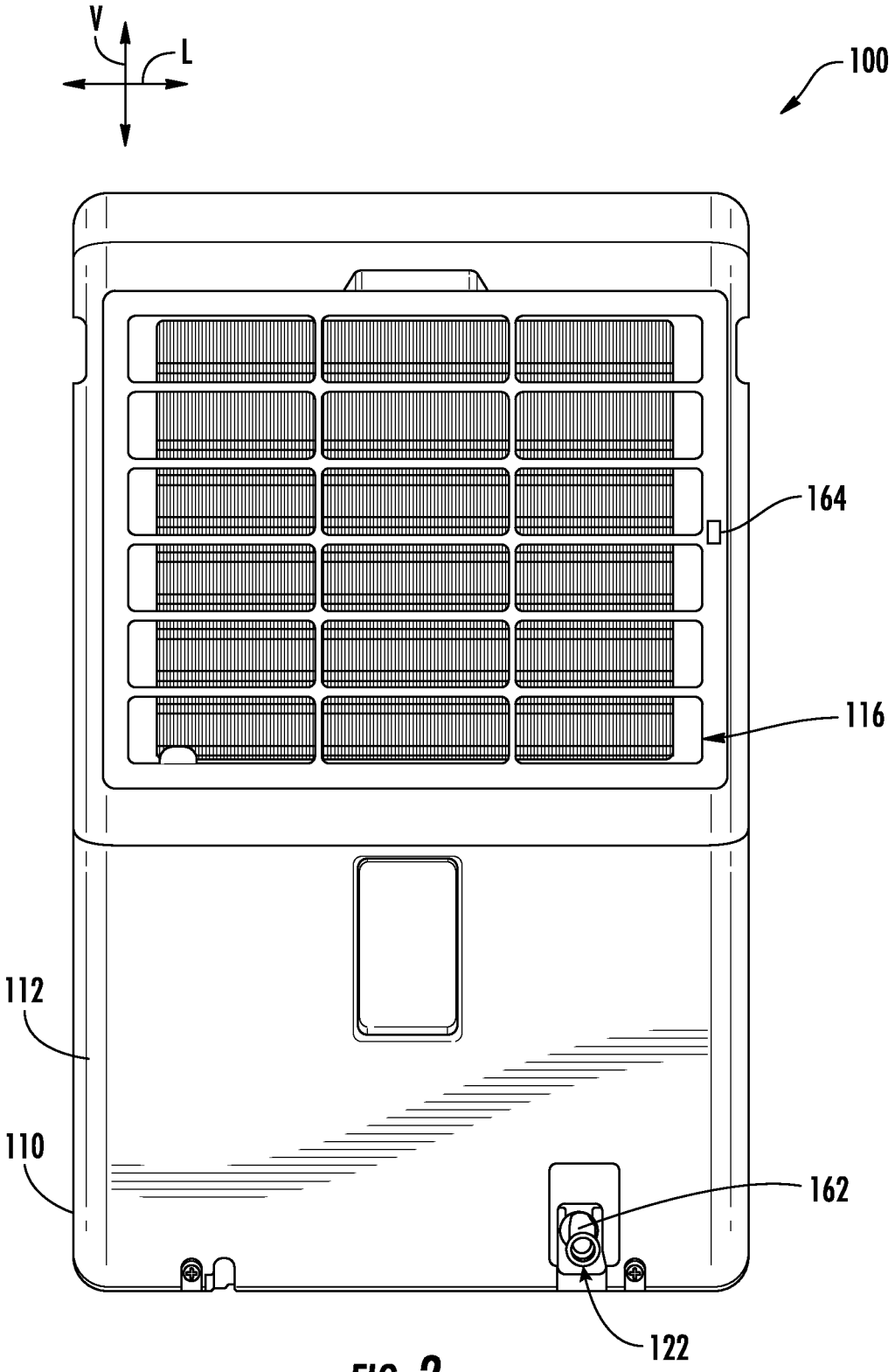
FIG. 2 provides a rear elevation view of the exemplary dehumidifier appliance of FIG. 1.
Figure 3:
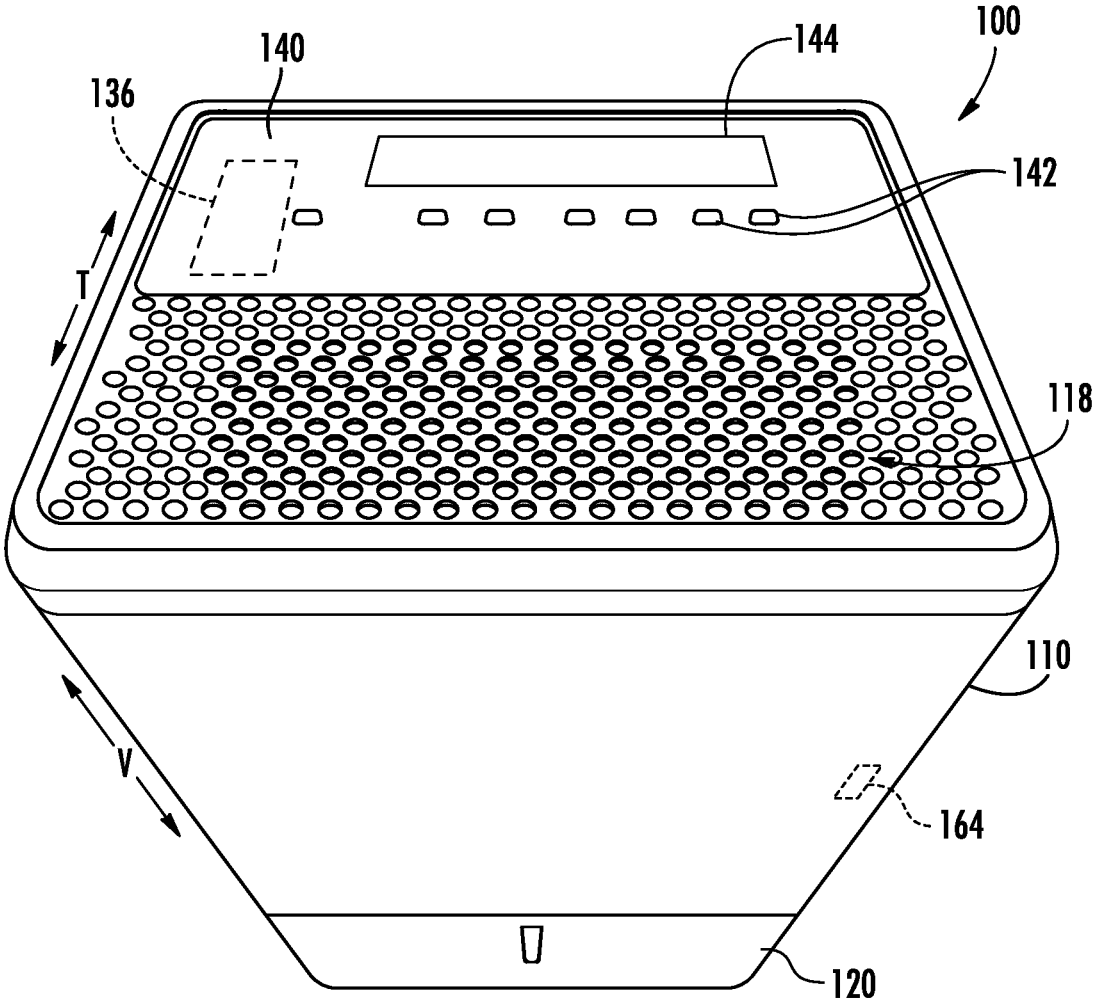
FIG. 3 provides a top perspective view of the exemplary dehumidifier appliance of FIG. 1.
Figure 4:
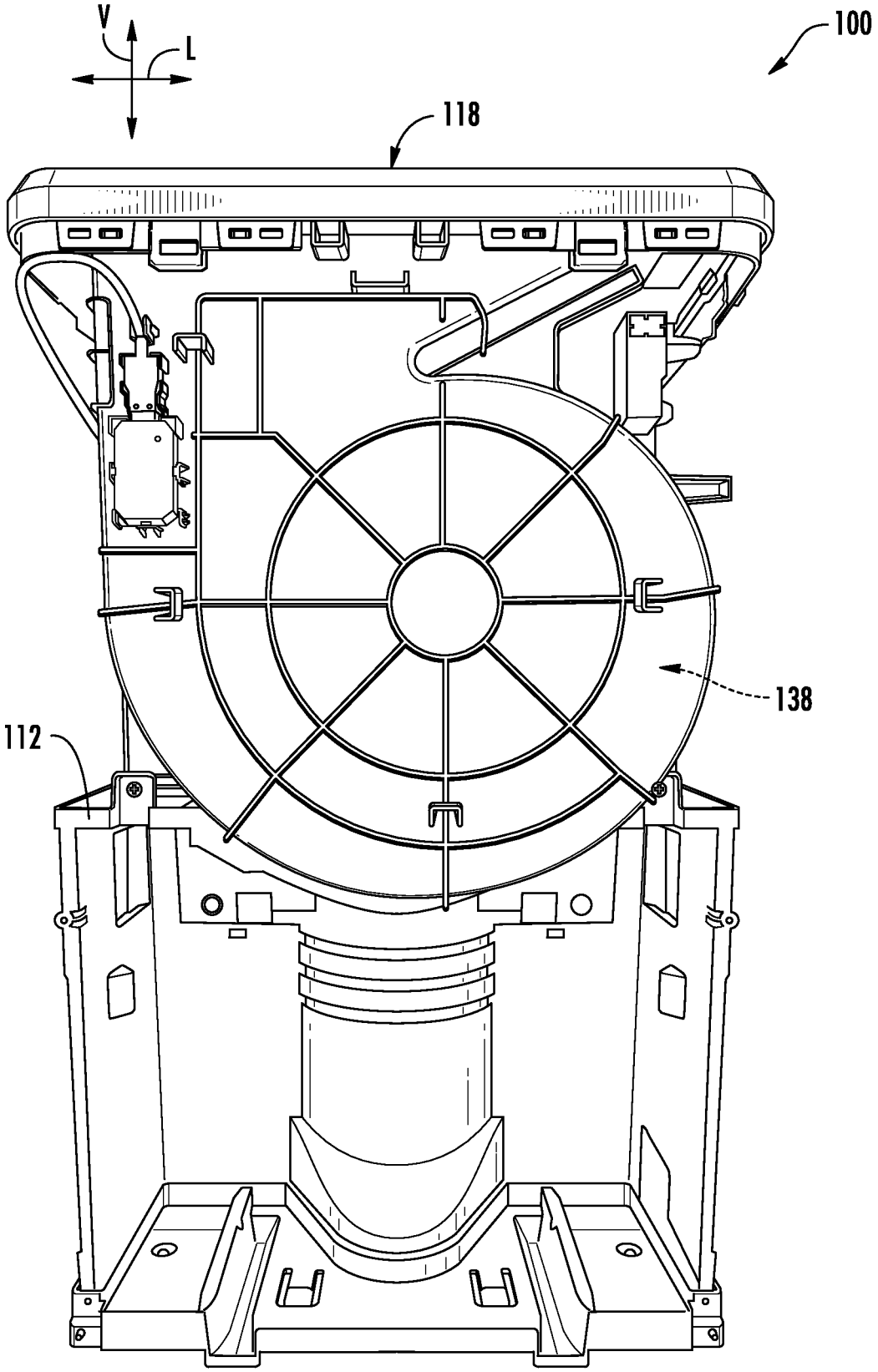
FIG. 4 provides a front perspective view of the exemplary dehumidifier appliance of FIG. 1, wherein an outer panel and water bucket have been removed for clarity.
Figure 5:
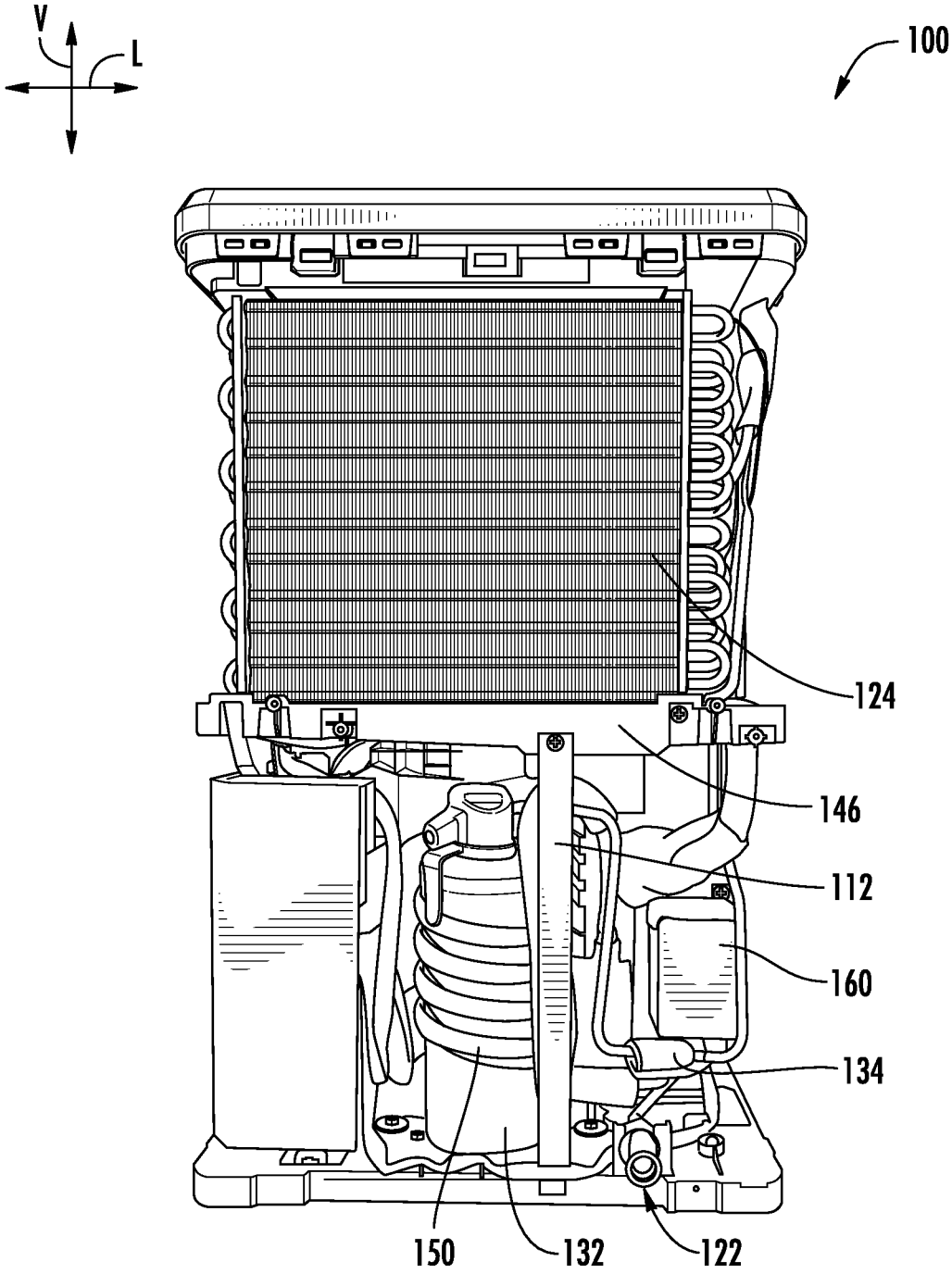
FIG. 5 provides a rear perspective view of the exemplary dehumidifier appliance of FIG. 1, wherein an outer panel has been removed for clarity.
Figure 6:
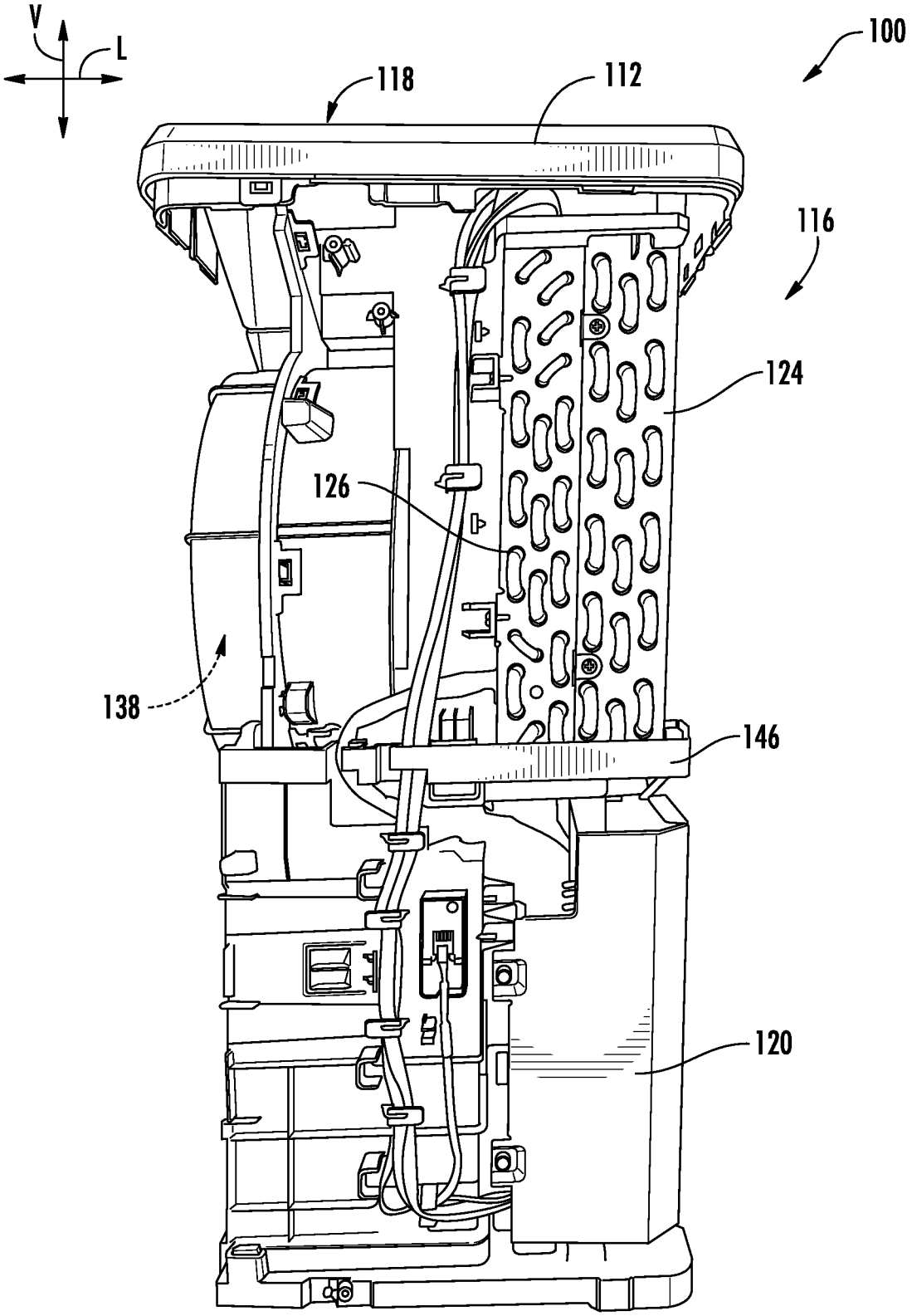
FIG. 6 provides a side perspective view of the exemplary dehumidifier appliance of FIG. 1, wherein an outer panel has been removed for clarity.
Figure 7:
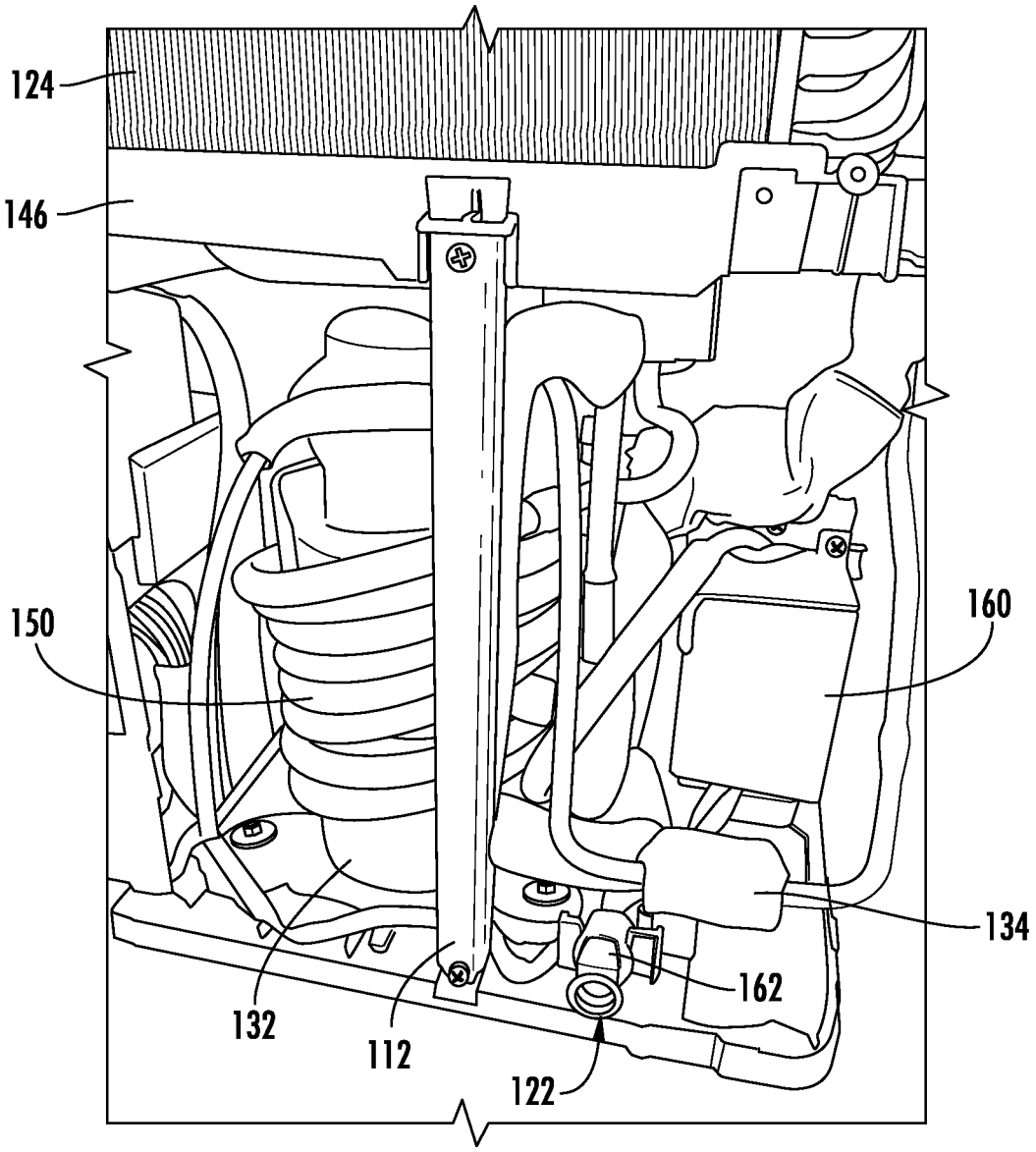
FIG. 7 provides a magnified perspective view of a portion of the exemplary dehumidifier appliance of FIG. 1.

Turning now to the figures, FIGS. 1 through 3 provide various views of an assembled dehumidifier appliance 100 according to exemplary embodiments of the present disclosure. Generally, dehumidifier appliance 100 includes a cabinet 110 that defines a vertical direction V, a lateral direction L, and a transverse direction T. Each direction V, L, T is perpendicular to the other directions, such that an orthogonal coordinate system is generally defined. As would be understood, cabinet 110 may include a frame 112 and one or more outer panels covering various portions of frame 112. As will be described in greater detail below, various components of dehumidifier appliance 100 may be housed therein. In particular, one more portions of a refrigeration assembly (e.g., refrigeration loop 130) are mounted within cabinet 110.

Along with housing various components, cabinet 110 defines an airflow passage between an air inlet 116 and an air outlet 118 spaced apart from the air inlet 116. In some embodiments, cabinet 110 defines air inlet 116 at a front grill that extends over a front face of cabinet 110. In additional or alternative embodiments, cabinet 110 defines air outlet 118 at a top grill (e.g., positioned at a top end of cabinet 110 or otherwise above air inlet 116). Thus, relative to the direction of airflow through cabinet 110, air outlet 118 may be defined downstream from air inlet 116 and thereabove. During use, ambient air may flow into air inlet 116 and through cabinet 110 (e.g., via natural convection or forced airflow motivated by an internal fan). Within cabinet 110, water vapor or moisture may be removed from the air (i.e., the air within cabinet 110 may be dehumidified). From the cabinet 110, such dehumidified air may be expelled (e.g., upward) through air outlet 118 and returned to the ambient environment.

In some embodiments, a water tank 120 defining a reservoir is mounted (e.g., removably mounted) to cabinet 110 to receive at least a portion of the water condensation. For instance, water tank 120 may be slidably mounted to cabinet 110 below an evaporator 124. Nonetheless, as would be understood—and except as otherwise indicated—dehumidifier appliance 100 may be provided without or adapted to function without a tank for collecting water and, instead, direct water condensation directly outside of cabinet 110 (e.g., through an outlet port 122) to the ambient environment or a separate drain line.

Figure 8:
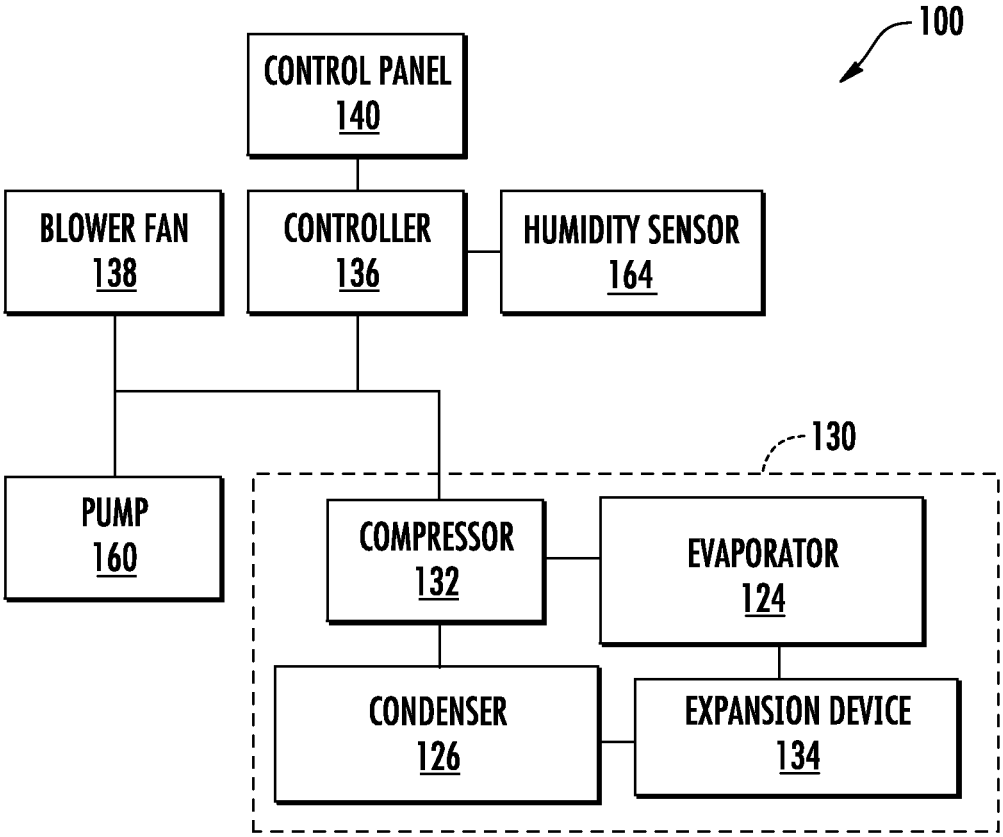
FIG. 8 provides a schematic view of the exemplary dehumidifier appliance of FIG. 1.

Referring now also to FIGS. 4 through 8, FIGS. 4 through 7 provide various views of dehumidifier appliance 100 wherein various portions (e.g., outer casing or water tank 120) have been removed for clarity. FIG. 8 provides a schematic view of dehumidifier appliance 100 illustrating operable connections between various features. It should be appreciated that the construction of dehumidifier appliance 100 and the configuration of its various components may vary without departing from the scope of the present subject matter.

As shown, a refrigeration loop 130 having a discrete evaporator 124 and condenser 126 may be included with dehumidifier appliance 100. Specifically, evaporator 124 may be disposed along the airflow path within cabinet 110. Relative to the flow of air, evaporator 124 may thus be mounted downstream from air inlet 116. In some embodiments, condenser 126 is further disposed along the airflow path within cabinet 110. For instance, relative to the flow of air, condenser 126 may be mounted between evaporator 124 and air outlet 118 (i.e., downstream from evaporator 124 and upstream from air outlet 118).

Refrigeration loop 130 may further include compressor 132 and an expansion device 134 mounted within cabinet 110 (e.g., below evaporator 124 or otherwise apart therefrom). As illustrated, compressor 132 and expansion device 134 may be in fluid communication with condenser 126 and evaporator 124 to flow refrigerant therethrough, as is generally understood. More particularly, refrigeration loop 130 may include various lines for flowing refrigerant between the various components of refrigeration loop 130, thus providing the fluid communication there between. Refrigerant may thus flow through such lines from evaporator 124 to compressor 132, from compressor 132 to condenser 126, from condenser 126 to expansion device 134, and from expansion device 134 to evaporator 124. The refrigerant may generally undergo phase changes associated with a refrigeration cycle as it flows to and through these various components, as is generally understood. One suitable refrigerant for use in refrigeration loop 130 is 1,1,1,2-Tetrafluoroethane, also known as R-134A, although it should be understood that the present disclosure is not limited to such example and rather that any suitable refrigerant may be used.

In some embodiments, compressor 132 is a variable speed compressor 132. In this regard, compressor 132 may be operated at various speeds depending on the dehumidification needs of the room (i.e., the room in which the appliance 100 is disposed) and the demand from refrigeration loop 130. For example, compressor 132 may be configured to operate at any speed between a minimum speed to a maximum rated speed. In some embodiments, use of variable speed compressor 132 enables efficient operation of refrigeration loop 130 (and thus dehumidifier appliance 100), minimizes unnecessary noise when compressor 132 does not need to operate at full speed, and ensures a comfortable environment within the corresponding room. During a dehumidification routine, moisture within the air may thus be condensed at the evaporator 124 without excessively reducing the temperature thereof.

As shown, expansion device 134 may be disposed within the cabinet 110 in fluid communication between the evaporator 124 and the condenser 126 relative to the flow of refrigerant. In some embodiments, expansion device 134 is an electronic expansion valve that generally enables controlled expansion of refrigerant. More specifically, electronic expansion device 134 may be configured to precisely control the expansion of the refrigerant to maintain, for example, a desired temperature differential of the refrigerant across the evaporator 124. In other words, electronic expansion device 134 selectively throttles the flow of refrigerant based on the reaction of the temperature differential across evaporator 124 or the amount of superheat temperature differential, thereby ensuring that the refrigerant is in the gaseous state entering compressor 132. In alternative embodiments, expansion device 134 may be a capillary tube or another suitable expansion device configured for use in a thermodynamic cycle.

In optional embodiments, a blower fan 138 may be mounted within cabinet 110 and directed at evaporator 124 to encourage or motivate the flow of air across evaporator 124. For instance, blower fan 138 may be positioned downstream of evaporator 124 relative to the airflow path through cabinet 110, as shown, to pull air through evaporator 124. Alternatively, though, blower fan 138 may be positioned upstream of evaporator 124 along the airflow path, and may operate to push air through evaporator 124.

The operation of dehumidifier appliance 100, including compressor 132, blower fan 138, expansion device 134, or other components of refrigeration loop 130 may be controlled by a processing device, such as a controller 136. Controller 136 may be operably coupled (via for example a suitable wired or wireless connection) to such components of the dehumidifier appliance 100. By way of example, the controller 136 may include a memory (e.g., non-transitive storage media) and one or more processing devices such as microprocessors, CPUs or the like, such as general or special purpose microprocessors operable to execute programming instructions or micro-control code associated with operation of dehumidifier appliance 100. The memory may represent random access memory such as DRAM, or read only memory such as ROM or FLASH. In one embodiment, the processor executes programming instructions stored in memory. The memory may be a separate component from the processor or may be included onboard within the processor.

In some embodiments, dehumidifier appliance 100 includes a control panel 140 and one or more user inputs 142, which may be included in control panel 140. The user inputs 142 may be operably coupled to the controller 136. A user of the dehumidifier appliance 100 may interact with the user inputs 142 to operate the dehumidifier appliance 100, and user commands may be transmitted (e.g., as command signals) between the user inputs 142 and controller 136 to facilitate operation of the dehumidifier appliance 100 based on such user commands. In particular, a unit may select a humidity input or relative amount of dehumidification at control panel 140. A display 144 may additionally be provided in the control panel 140, and may be operably coupled to the controller 136. Display 144 may, for example be a touchscreen or other text-readable display 144 screen, or alternatively may simply be a light that can be activated and deactivated as required to provide an indication of, for example, an event or setting for the dehumidifier appliance 100.

As noted above, water condensation collects on or at evaporator 124 during use. As shown, a collection tray 146 is disposed below the evaporator 124 to receive at least a portion of such water. An elevated rim may extend above a bottom wall such that water can gather within collection tray 146. Collection tray 146 is thus generally open along the vertical direction V to receive water as it falls. A tray outlet (not pictured) may be defined through the bottom wall and thus permit water to flow therefrom (e.g., to a separate line or portion of cabinet 110).

In some embodiments, an extended water conduit 150 is disposed within the cabinet 110 downstream from collection tray 146. As an example, extended water conduit 150 may be coiled (e.g., as a helix) within cabinet 110 such that multiple passes (e.g., three or more segments that each wrap 360° and) extend about a central void. Thus, water may flow from collection tray 146 and about the central void as it flows downward and downstream.

In optional embodiments, a water pump 160 is disposed in fluid communication with extended water conduit 150. Specifically, water pump 160 may be mounted within cabinet 110 downstream from collection tray 146 to motivate water through extended water conduit 150. In some embodiments, water pump 160 may be disposed downstream from extended water conduit 150 or water tank 120. Moreover, water pump 160 may be disposed upstream from an outlet port 122 through cabinet 110. Outlet port 122 may be defined through cabinet 110 (e.g., at a selectively actuated valve 162 or outlet line, generally) and directed outside of cabinet 110 (e.g., to the ambient environment or a connected extension line). Thus, water pump 160 may be selectively activated (e.g., by controller 136 in operable communication with water pump 160) to motivate water from water tank 120, or appliance 100 generally.

According to exemplary embodiments, dehumidifier appliance 100 may include one or more humidity sensors 164 which are in operative communication within controller 136. In this manner, humidity sensor 164 may measure room humidity and provide a corresponding signal to controller 136 to facilitate closed loop operation of dehumidifier appliance 100. As used herein, the terms "humidity sensor" or the equivalent may be intended to refer to any suitable type of humidity measuring system or device positioned at any suitable location for measuring the desired humidity. Thus, for example, "humidity sensor" may refer to any suitable type of humidity sensor, such as capacitive digital sensors, resistive sensors, and thermal conductivity humidity sensors. In addition, humidity sensor 164 may be positioned at any suitable location and may output a signal, such as a voltage, to a controller that is proportional to and/or indicative of the humidity being measured. Although exemplary positioning of humidity sensors is described herein, it should be appreciated that dehumidifier appliance 100 may include any other suitable number, type, and position of humidity sensors according to alternative embodiments.

Referring again to FIG. 1, a schematic diagram of an external communication system 170 will be described according to an exemplary embodiment of the present subject matter. In general, external communication system 170 is configured for permitting interaction, data transfer, and other communications between dehumidifier appliance 100 and one or more external devices. For example, this communication may be used to provide and receive operating parameters, user instructions or notifications, performance characteristics, user preferences, or any other suitable information for improved performance of dehumidifier appliance 100. In addition, it should be appreciated that external communication system 170 may be used to transfer data or other information to improve performance of one or more external devices or appliances and/or improve user interaction with such devices.

For example, external communication system 170 permits controller 136 of dehumidifier appliance 100 to communicate with a separate device external to dehumidifier appliance 100, referred to generally herein as an external device 172. As described in more detail below, these communications may be facilitated using a wired or wireless connection, such as via a network 174. In general, external device 172 may be any suitable device separate from dehumidifier appliance 100 that is configured to provide and/or receive communications, information, data, or commands from a user. In this regard, external device 172 may be, for example, a personal phone, a smartphone, a tablet, a laptop or personal computer, a wearable device, a smart home system, or another mobile or remote device.

In addition, a remote server 176 may be in communication with dehumidifier appliance 100 and/or external device 172 through network 174. In this regard, for example, remote server 176 may be a cloud-based server 176, and is thus located at a distant location, such as in a separate state, country, etc. According to an exemplary embodiment, external device 172 may communicate with a remote server 176 over network 174, such as the Internet, to transmit/receive data or information, provide user inputs, receive user notifications or instructions, interact with or control dehumidifier appliance 100, etc. In addition, external device 172 and remote server 176 may communicate with dehumidifier appliance 100 to communicate similar information.

In general, communication between dehumidifier appliance 100, external device 172, remote server 176, and/or other user devices or appliances may be carried using any type of wired or wireless connection and using any suitable type of communication network, non-limiting examples of which are provided below. For example, external device 172 may be in direct or indirect communication with dehumidifier appliance 100 through any suitable wired or wireless communication connections or interfaces, such as network 174. For example, network 174 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Figure 9:
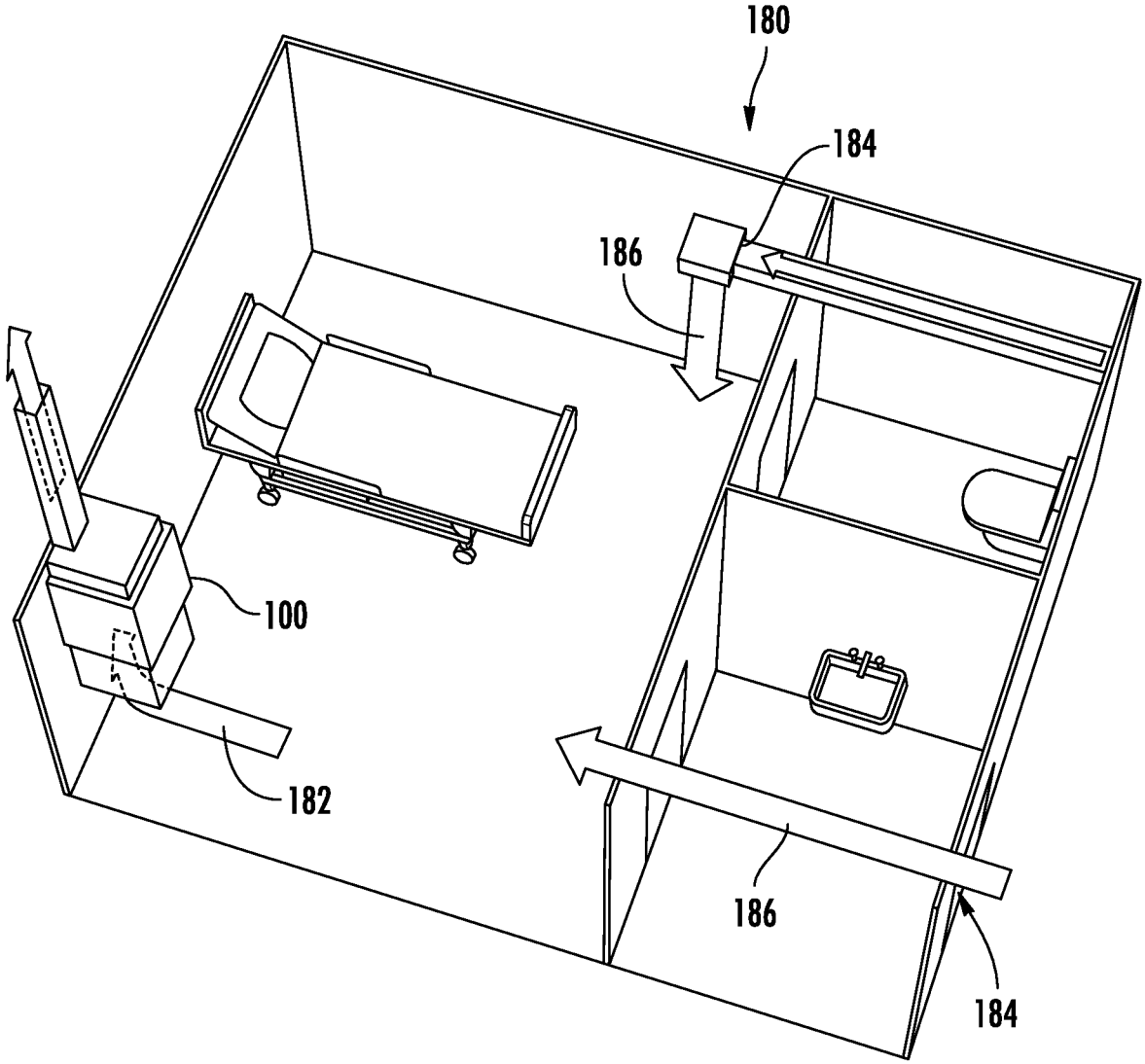
FIG. 9 illustrates an exemplary dehumidifier placed within a room in accordance with an embodiment of the present disclosure.

Referring now briefly to FIG. 9, an exemplary dehumidifier placed within a room 180 in accordance with an embodiment of the present disclosure will be described. For example, the dehumidifier may be same as or similar to dehumidifier appliance 100 described above. As illustrated, when dehumidifier appliance 100 is performing a dehumidification cycle, a flow of air 182 passes through the dehumidifier appliance 100 to be dehumidified before being ejected back into the room. Under normal operating circumstances with a properly functioning dehumidifier, the humidity of the air within room 180 may slowly be driven to a target humidity, e.g., the desired humidity set by the user using control panel 140.

However, as explained above, during certain situations, dehumidifier appliance 100 may fail to properly dehumidify the room 180, e.g., may fail to drive the measured humidity to the target humidity in a timely manner. This failure may be indicative of a malfunctioning unit, but that is not always the case. For example, as shown in FIG. 9, room 180 may further define one or more external sources of humidity (e.g., identified generally by reference numeral 184). In general, these "external sources of humidity" may refer to any source of air or moisture that may increase the humidity within room 180.

For example, according to the illustrated embodiment, external sources of humidity 184 include an open window and an exhaust vent, both of which may let in a flow of humid air (e.g., identified generally by reference numeral 186) if not blocked or if otherwise left open. According to still other embodiments, the external source of humidity 184 may include a competing air conditioner unit, a humidifier appliance, or any other source of air moisture. As explained above, these flows of humid air 186 may result in the failure of dehumidifier appliance 100 to achieve the target humidity, which may be incorrectly assumed to be a fault with the appliance itself. Aspects of the present subject matter are directed to methods for properly diagnosing faults in a dehumidifier appliance.

Now that the construction of dehumidifier appliance 100 and the configuration of controller 136 according to exemplary embodiments have been presented, an exemplary method 200 of operating a dehumidifier appliance will be described. Although the discussion below refers to the exemplary method 200 of operating dehumidifier appliance 100, one skilled in the art will appreciate that the exemplary method 200 is applicable to the operation of a variety of other dehumidifier or air conditioning appliances. In exemplary embodiments, the various method steps as disclosed herein may be performed by controller 136 or a separate, dedicated controller.

Figure 10:
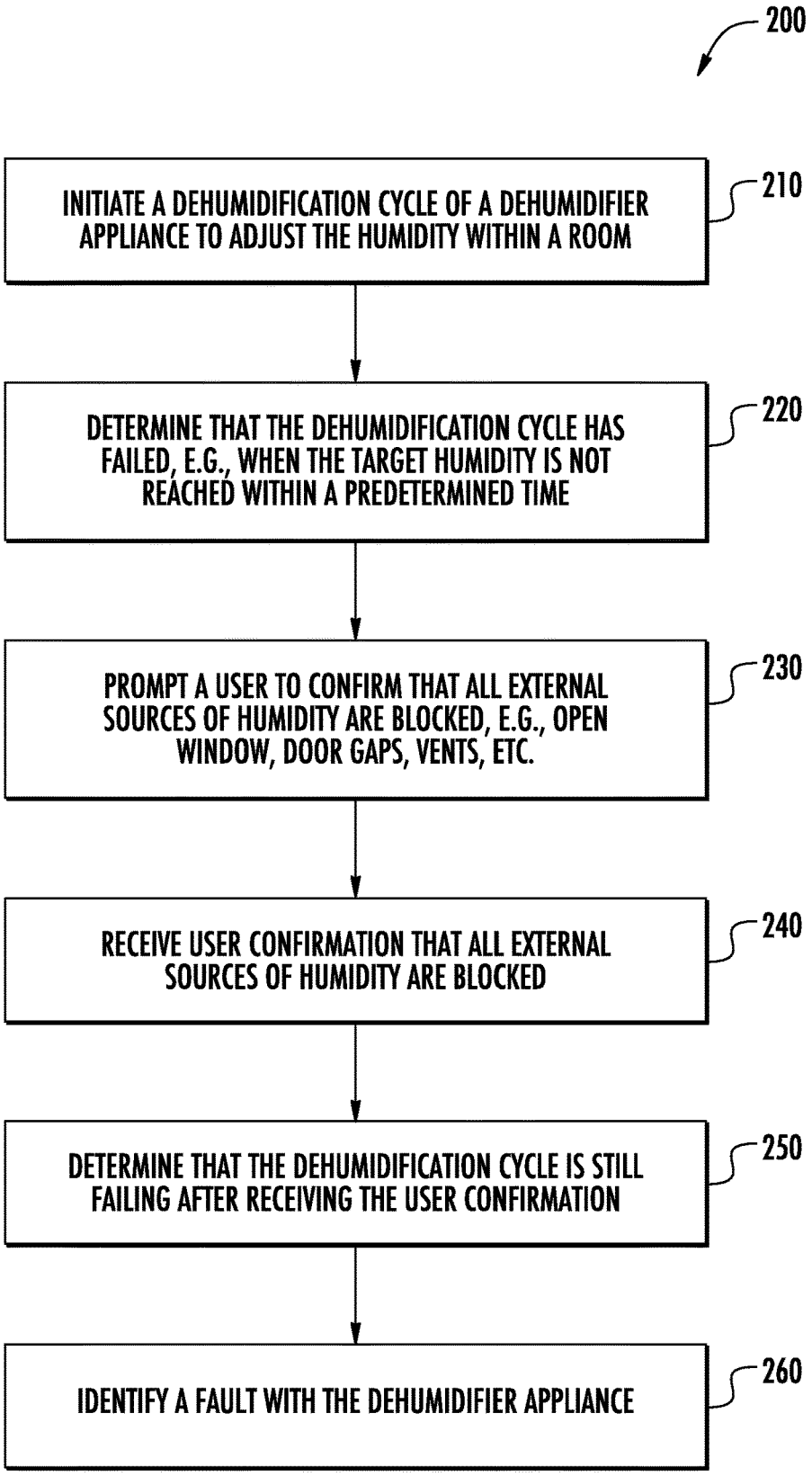
FIG. 10 illustrates a method for operating a dehumidifier appliance in accordance with one embodiment of the present disclosure.

Referring now to FIG. 10, method 200 includes, at step 210, initiating a dehumidification cycle of a dehumidifier appliance to adjust the humidity within a room. In this regard, continuing the example from above, dehumidifier appliance 100 may be activated to reduce the humidity within room 180. In this regard, controller 136 of dehumidifier appliance 100 may activate blower fan 138 to start circulating the flow of air 182 through the refrigeration loop 130 while compressor 132 may operate to circulate refrigerant within that loop. In this manner, if the humidifier appliance 100 is operating properly, the humidity within the flow of air 182 should slowly decrease until a target humidity is reached, at which time dehumidifier appliance 100 may be stopped.

Step 220 may include determining that the dehumidification cycle has failed. In this regard, controller 136 may be programmed with a target room humidity and may operate in order to drive a measured humidity (e.g., as measured by humidity sensor 164) to the target humidity. However, in situations where controller 136 determines that the humidifier appliance 100 is failing to drive the measured temperature to the target temperature at the desired rate or within the desired time, controller 136 may make a determination that the dehumidification cycle has failed. Although exemplary methods for making such a determination are provided below, it should be appreciated that variations and modifications for making such a determination are possible and within scope the present subject matter.

According to an exemplary embodiment, determining that the dehumidification cycle has failed may include measuring a room humidity with humidity sensor 164 and determining that the measured humidity has not reached the target humidity within a predetermined dehumidification time. For example, the predetermined dehumidification time may generally correspond with the time it takes a properly operating the humidifier to adjust the room humidity to the target humidity, e.g., such as between about 10 minutes and 3 hours, between about 30 minutes and 2 hours, or about 1 hour. Other predetermined dehumidification times are possible and within the scope present subject matter.

According to still other exemplary embodiments, determining that the dehumidification cycle has failed may include determining that dehumidification rate falls below a predetermined rate threshold. In this regard, using data from humidity sensor 164, controller 136 may estimate the average rate of dehumidification (e.g., change in relative humidity over time) and determine that the estimated rate falls below a preprogrammed or otherwise calculated target rate. This rate may be determined based on historical data regarding operation of dehumidifier appliance 100 or may be set in any other suitable manner.

In addition, determining that the dehumidification cycle has failed may include debounce procedures to prevent such a determination when dehumidifier appliance 100 is in fact operating properly. For example, if a room is quickly supplied with a large amount of humidity (e.g., by opening the door on a humid day), it may take longer than the predetermined amount of time to remove humidity from the air. Accordingly, determining that the dehumidification cycle has failed may include implementing a plurality of consecutive dehumidification cycles and determining that the measured humidity does not reach a target humidity in any of the consecutive dehumidification cycles (e.g., or the dehumidification rate does not meet the target rate). For example, the humidifier appliance 100 may operate through 5, 7, 10, or more dehumidification cycles before the determination is made that the dehumidification cycle has failed.

Notably, as explained above, there are scenarios where controller 136 may determine that the dehumidification cycle has failed, but such failure may not be due to the operation or functioning of dehumidifier appliance 100 itself. For example, if a user has left open a door or a window, a large and continuous inflow of humid air 186 may overcome the capacity of dehumidifier appliance 100. During such situations, it may be desirable to identify these issues instead of falsely determining that the dehumidifier appliance 100 is malfunctioning.

Accordingly, step 230 may generally include prompting the user to confirm that all external sources of humidity are blocked. In this regard, after determining that the dehumidification of cycle has failed (e.g., at step 220), controller 136 may instruct the user to investigate other sources humidity that may be the actual reason for the dehumidification "failure." Step 240 may include receiving a user confirmation that all external sources of humidity are blocked. In this regard, the user may reply to the prompt issued at step 230, indicating that there are no other substantial sources of external humidity.

In this regard, in response to the prompt issued at step 230, a user may identify the window is open or the exhaust vent to a bathroom fan is left open position. The user may rectify the condition and provide a user confirmation at step 240. Step 250 generally includes determining that the dehumidification cycle is still failing after receiving the user confirmation. In this regard, the humidifier appliance 100 may continue the dehumidification cycle or may initiate a new dehumidification cycle. If the dehumidification cycle is still failing (e.g., as determined in a manner similar to that described above), step 260 may include identifying a fault with the dehumidifier appliance.

Notably, steps 230 of prompting the user and 240 of receiving a user confirmation may include receiving a user confirmation that specifies that the user has checked for external sources of humidity and has identified none. In such situation, step 250 may be omitted and method 200 may proceed to step 260 where a fault is identified. In this regard, if the user took no corrective action to block external sources of humidity, it is likely that the outcome of a subsequent dehumidification cycle will be the same as the previous cycles, i.e., a dehumidification failure.

Notably, steps 230 and 240 of prompting the user and receiving a user confirmation may be performed by controller 136 via control panel 140, via remote device 172 over network 174, or using any other suitable communication means. For example, the user may be prompted to confirm that all external sources of humidity are blocked through a push notification to a mobile phone. The user may perform such a confirmation and then may select a response to the push notification at step 240.

In the event a fault is identified at step 260, various subsequent actions may be taken by controller 136 to facilitate correction of such malfunction. In this regard, for example, controller 136 may perform an internal troubleshooting process to identify the source of the fault and may communicate that fault source to the user. According to still alternative embodiments, controller 136 may instruct the user to schedule maintenance visit or may directly schedule maintenance visit via network 174. Other suitable responsive actions are possible and within the scope of the present subject matter.

FIG. 10 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using dehumidifier appliance 100 as an example, it should be appreciated that these methods may be applied to the operation of any suitable dehumidifier or air conditioner unit.

As explained above, aspects of the present subject matter are generally directed to a method of identifying faults in a dehumidifier. Specifically, when a measured room humidity level does not reach a target humidity level (e.g., set at the humidifier) within a predetermined time, this may indicate that there is a problem in the dehumidifier. Notably, these failures may result in uncomfortable conditions for the room occupant and excessive energy expenses. However, it should be noted that if large amounts of ambient air are leaking into the dehumidified room, the humidity may never reach the target humidity, despite the proper operation of the dehumidifier.

Accordingly, the present methods may determine whether the dehumidifier is malfunctioning with cycle data, e.g., by determining that the reason that the current humidity is not reaching the target is due to a lot of outside air constantly flowing inside or due to a malfunction with the dehumidifier. For example, when the current humidity does not reach the target humidity at least one time during a predetermined dehumidification time (e.g., a 1-hour cycle), then a remote server may consider that the dehumidifier is running a failed cycle. If the dehumidifier performs a predetermined number of failed cycles (e.g., 7 cycles) without successful dehumidification, the remote server may assume that a lot of outside air is constantly flowing inside.

In this situation, the method may include recommending to the user to block all external airflow paths into the room (e.g., door gaps, windows, exhaust vents, etc.) and then run the dehumidifier again. If a successful dehumidification cycle is performed, the remote server may determine that the poor performance was due to outside air being let into the conditioned room. By contrast, if the dehumidification cycle again fails, the remote server may determine that there is a fault with the dehumidifier and may take corrective action, e.g., by notifying the user, scheduling a maintenance visit, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dehumidifier appliance comprising:

a cabinet defining an airflow path that extends between an air inlet and an air outlet spaced apart from the air inlet;

an air handler operably coupled to the airflow path for selectively urging a flow of air therethrough;

a refrigeration assembly mounted within the cabinet along the airflow path for selectively dehumidifying the flow of air; and a controller in operative communication with the air handler and the refrigeration assembly, the controller being configured to:

initiate a dehumidification cycle;

determine that the dehumidification cycle has failed;

prompt a user to confirm that all external sources of humidity are blocked;

receive user confirmation that all external sources of humidity are blocked;

determine that the dehumidification cycle is still failing after receiving the user confirmation; and identify a fault with the dehumidifier appliance.

2. The dehumidifier appliance of claim 1, wherein determining that the dehumidification cycle has failed comprises:

determining that a measured humidity has not reached a target humidity within a predetermined dehumidification time.

3. The dehumidifier appliance of claim 2, wherein the predetermined dehumidification time is between about 30 minutes and 2 hours.

4. The dehumidifier appliance of claim 2, wherein the predetermined dehumidification time is 1 hour.

5. The dehumidifier appliance of claim 1, wherein determining that the dehumidification cycle has failed comprises:

determining that a dehumidification rate falls below a predetermined rate threshold.

6. The dehumidifier appliance of claim 1, wherein determining that the dehumidification cycle has failed comprises:

implementing a plurality of consecutive dehumidification cycles; and determining that a measured humidity does not reach a target humidity in any of the consecutive dehumidification cycles.

7. The dehumidifier appliance of claim 6, wherein the plurality of consecutive dehumidification cycles comprises between 7 and 10 cycles.

8. The dehumidifier appliance of claim 1, further comprising:

a user interface panel mounted to the cabinet, wherein the user is prompted and the user confirmation is received through the user interface panel.

9. The dehumidifier appliance of claim 1, wherein the dehumidifier appliance is in operative communication with a remote device through an external network, and wherein the user is prompted and the user confirmation is received through the remote device.

10. The dehumidifier appliance of claim 1, wherein the controller is further configured to:

advise the user to request a service visit or perform maintenance on the dehumidifier appliance upon identifying the fault with the dehumidifier appliance.

11. The dehumidifier appliance of claim 1, wherein the refrigeration assembly comprises:

a refrigeration loop disposed along the airflow path and comprising an evaporator and a condenser in fluid communication;

a compressor mounted within the cabinet and operably coupled to the refrigeration loop to motivate refrigerant therethrough; and an expansion device operably coupled to the refrigeration loop.

12. The dehumidifier appliance of claim 1, further comprising:

a collection tray disposed below an evaporator to receive water condensation therefrom.

13. A method of diagnosing faults in a dehumidifier appliance, the method comprising:

initiating a dehumidification cycle;

determining that the dehumidification cycle has failed;

prompting a user to confirm that all external sources of humidity are blocked;

receiving user confirmation that all external sources of humidity are blocked;

determining that the dehumidification cycle is still failing after receiving the user confirmation; and identifying a fault with the dehumidifier appliance.

14. The method of claim 13, wherein determining that the dehumidification cycle has failed comprises:

determining that a measured humidity has not reached a target humidity within a predetermined dehumidification time.

15. The method of claim 14, wherein the predetermined dehumidification time is between about 30 minutes and 2 hours.

16. The method of claim 14, wherein the predetermined dehumidification time is 1 hour.

17. The method of claim 13, wherein determining that the dehumidification cycle has failed comprises:

determining that a dehumidification rate falls below a predetermined rate threshold.

18. The method of claim 13, wherein determining that the dehumidification cycle has failed comprises:

implementing a plurality of consecutive dehumidification cycles; and determining that a measured humidity does not reach a target humidity in any of the consecutive dehumidification cycles.

19. The method of claim 18, wherein the plurality of consecutive dehumidification cycles comprises between 7 and 10 cycles.

20. The method of claim 13, wherein the user is prompted and the user confirmation is received through a user interface panel of the dehumidifier appliance or through a remote device in operative communication with the dehumidifier appliance through an external network.

* * * * *